US011612232B1

(12) United States Patent
Ward et al.

(10) Patent No.: US 11,612,232 B1
(45) Date of Patent: Mar. 28, 2023

(54) ATTACHABLE SPORTS BAG FOR USE ALONE OR IN CONJUNCTION WITH ANOTHER BACKPACK

(71) Applicant: VAMOSE LLC, Ames, IA (US)

(72) Inventors: Anthony Matthias Ward, Ames, IA (US); Benjamin James Grote, Ames, IA (US)

(73) Assignee: VAMOSE LLC, Ames, IA (US)

( * ) Notice: Subject to any disclaimer, the term of this patent is extended or adjusted under 35 U.S.C. 154(b) by 219 days.

(21) Appl. No.: 17/093,065

(22) Filed: Nov. 9, 2020

Related U.S. Application Data

(60) Provisional application No. 62/932,714, filed on Nov. 8, 2019.

(51) Int. Cl.
*A45F 3/04* (2006.01)
*A45F 3/12* (2006.01)
*A45F 3/00* (2006.01)

(52) U.S. Cl.
CPC ..... *A45F 3/047* (2013.01); *A45F 3/12* (2013.01); *A45F 3/04* (2013.01); *A45F 2003/003* (2013.01)

(58) Field of Classification Search
CPC .... A45F 3/04; A45F 3/08; A45F 3/042; A45F 3/047; A45F 3/12
USPC ..... 224/583, 627, 628, 645, 657, 652, 684, 224/664; D3/216, 217
See application file for complete search history.

(56) References Cited

U.S. PATENT DOCUMENTS 243,363 A * 6/1881 Crouch ..... A45F 3/00 224/684
5,004,134 A * 4/1991 Barry ..... A45C 3/10 224/650
5,131,576 A * 7/1992 Turnipseed ..... A45F 3/08 224/907
D333,570 S * 3/1993 Murray ..... D3/226
5,240,156 A * 8/1993 Sicotte ..... A45F 5/02 224/583
5,353,975 A * 10/1994 Libertucci ..... A45F 5/00 224/664
5,509,589 A * 4/1996 Kliot ..... A63C 17/00 224/656
D379,559 S * 6/1997 Maez ..... D3/226
D380,294 S * 7/1997 Kliot ..... D3/217
5,651,486 A * 7/1997 Kliot ..... A63C 17/00 224/653
D384,808 S * 10/1997 Carretta ..... D3/226
5,799,851 A * 9/1998 Wulf ..... A45F 3/047 224/582
D411,659 S * 6/1999 Karton ..... D3/226
(Continued)

*Primary Examiner* — Justin M Larson
(74) *Attorney, Agent, or Firm* — Nyemaster Goode, P.C.

(57) ABSTRACT

A backpack for use alone or in conjunction with a hiking or book backpack where the backpack includes a plurality of storage compartments, a main storage compartment, a first side storage compartment and a second side storage compartment. A top opening of the main compartment is accessed via the opening and closing mechanism to allow the user access to the interior volume of the main storage compartment when in a horizontal orientation and a top opening of the first compartment is accessed via the opening and closing mechanism of the first compartment, which is positioned at the top of the first compartment when the flexible backpack system is positioned in the vertical position and from the side when in the horizontal position.

19 Claims, 5 Drawing Sheets

(56) References Cited

U.S. PATENT DOCUMENTS

| | | | | | |
|---|---|---|---|---|---|
| D420,792 | S | * | 2/2000 | Sakelliou | D3/217 |
| 6,038,747 | A | * | 3/2000 | Hamilton | A45F 3/047 24/632 |
| D487,189 | S | * | 3/2004 | Ukitsu | D3/217 |
| 6,722,543 | B1 | * | 4/2004 | Fitzgerald | A45F 3/047 224/628 |
| 6,786,375 | B2 | * | 9/2004 | Worden | A63C 3/00 224/628 |
| 7,124,921 | B1 | * | 10/2006 | Hubbell | A45F 3/16 224/652 |
| 7,971,764 | B2 | * | 7/2011 | Sabbah | A45F 5/00 224/652 |
| D660,584 | S | * | 5/2012 | Cross | D3/217 |
| D674,184 | S | * | 1/2013 | Pintado | D3/224 |
| 8,893,940 | B2 | * | 11/2014 | Green | A45F 3/08 224/604 |
| D722,430 | S | * | 2/2015 | Sagan | D3/217 |
| D781,574 | S | * | 3/2017 | Bedford | D3/217 |
| D793,720 | S | * | 8/2017 | Tien | D3/226 |
| D805,766 | S | * | 12/2017 | Bogue | D3/226 |
| D843,713 | S | * | 3/2019 | Li | D3/217 |
| D872,473 | S | * | 1/2020 | Yu | D3/289 |
| 11,388,978 | B2 | * | 7/2022 | Cigard | A45F 3/04 |
| 2007/0045370 | A1 | * | 3/2007 | Hsieh | A45F 3/04 190/110 |
| 2007/0125815 | A1 | * | 6/2007 | Tong | A45F 4/02 224/583 |
| 2016/0157588 | A1 | * | 6/2016 | Ford | A45F 3/04 224/657 |

* cited by examiner

ATTACHABLE SPORTS BAG FOR USE ALONE OR IN CONJUNCTION WITH ANOTHER BACKPACK

CROSS-REFERENCE TO RELATED APPLICATION(S)

This application claims priority to Provisional U.S. Application Ser. No. 62/932,714, filed on Nov. 8, 2019, entitled "Attachable Sports Bag for Backpacks," the disclosure of which is hereby incorporated herein by reference in its entirety.

BACKGROUND

Backpacks are used by a wide variety of people, and those who use them may have a need for extra storage that is kept separate from their main bag uses. For example, backpacks are becoming more prevalent in the workplace, and many business professionals participate in fitness related activities after work. Sports enthusiasts like hikers, golfers and hunters generally have bags or backpacks, but may have a need for extra storage. Those in school or work or others who play sports like basketball and soccer, which typically utilize special footwear or other gear that may get dirty or need to be kept clean for on court use, after school or work they may need a smaller, separable bag to keep their gym clothes or other elements away from their work or school supplies.

SUMMARY

One aspect of the present disclosure includes a backpack system that typically includes at least a first flexible backpack and optionally a second hiking or book backpack that may be interconnectedly engaged with one another via a strapping system of the first flexible backpack. The first flexible backpack typically includes an enlarged center section with a symmetrical zipper opening. The flexible backpack typically has a plurality of storage compartments including a main storage compartment, a first side storage compartment having a first side storage compartment interior volume and a second side storage compartment having a second side storage compartment volume. The main storage compartment typically has a main compartment interior volume that is greater than the first side storage compartment volume and the second side storage compartment volume. The flexible backpack system further typically includes a backplate having a first side and a second side with at least a first strap having opposing first strap ends engaged to each of the first side and the second side and a second strap having opposing second strap ends engaged to each of the first and second side wherein the first strap engaging ends and the second strap ends each engage one another via a buckling system that is operable by hand and without the use of tools and is chosen from the group consisting of a snap friction fitting connection buckle and a magnetic buckling system. Each of the compartments typically have an opening and closing mechanism chosen from the group consisting of a hook and loop fastening system and a zipper system. A top opening of the main compartment is accessed via the opening and closing mechanism to allow the user access to the interior volume of the main storage compartment when in a horizontal orientation and a top opening of the first compartment of the first compartment is access via the opening and closing mechanism of the first compartment, which is positioned at the top of the first compartment when the flexible backpack system is positioned in the vertical position and from the side when in the horizontal position.

Another aspect of the present disclosure includes a flexible backpack having a plurality of storage compartments, a center storage compartment, a left side storage compartment having a left side storage compartment interior volume and a right side storage compartment having a right side storage compartment volume. The center storage compartment has a center compartment interior volume that is greater than the left side storage compartment volume and the right side storage compartment volume. The flexible backpack system further typically includes a backplate having a first side and a second side with at least a first strap having first strap ends opposite one another and engaged to the first side and the second side and a second strap having second strap ends opposite one another and engaged to the first and second side wherein the first strap ends and the second strap ends each engage one another via a buckling system that is operable by hand and without the use of tools and is chosen from the group consisting of a snap friction fitting connection buckle and a magnetic buckling. Each of the compartments typically have a separate zipper system to allow selective access to the interior volume of each compartment. The top opening of the main compartment is accessed via the opening and closing mechanism to allow the user access to the interior volume of the main storage compartment when in a horizontal orientation and a top opening of the first compartment is accessed via the opening and closing mechanism of the first compartment, which is positioned at the top of the first compartment when the flexible backpack system is positioned in the vertical position and from the side when in the horizontal position. The two elongated planar fabric straps have a length of at least about 150% of the width of the backplate from top side of the left trapezoidal portion and the top side of the right trapezoidal portion.

Yet another aspect of the present disclosure includes a flexible backpack having a plurality of storage compartments, a center storage compartment, a left side storage compartment having a left side storage compartment interior volume and a right side storage compartment having a right side storage compartment volume. The center storage compartment has a center compartment interior volume that is greater than the left side storage compartment volume and the right side storage compartment volume. The flexible backpack system further typically includes a backplate having a first side and a second side with at least a first strap having first strap ends opposite one another and engaged to the first side and the second side and a second strap having second strap ends opposite one another and engaged to the first and second side wherein the first strap ends and the second strap ends each engage one another via a buckling system that is operable by hand and without the use of tools and is chosen from the group consisting of a snap friction fitting connection buckle and a magnetic buckling system. Each of the compartments typically have a separate zipper system to allow selective access to the interior volume of each compartment. A top opening of the main compartment is accessed via the opening and closing mechanism to allow the user access to the interior volume of the main storage compartment when in a horizontal orientation and a top opening of the first compartment is accessed via the opening and closing mechanism of the first compartment, which is positioned at the top of the first compartment when the flexible backpack system is positioned in the vertical position and from the side when in the horizontal position. The two elongated planar fabric straps have a length of at least about 150% of the width of the backplate from top side of the left trapezoidal portion and the top side of the right trapezoidal portion. The flexible backpack system further comprises a secondary compartment spaced behind the main compartment and between the main compartment and a backplate wherein the secondary compartment is openable and closeable via a zipper system that is linear along the top of the compartment when the flexible backpack is in the horizontal position.

Still another aspect of the disclosure includes a backpack attachment for use with a standard backpack or as a stand-alone backpack having a backplate, a center storage compartment on the backplate with a center zipper, a right side storage compartment on the backplate and located on the right side of the center storage compartment with a right zipper, a left side storage compartment on the backplate and located on the left side of the center storage compartment with a left zipper, and a strap assembly attached to the backplate with an adjustable strap that is configured to wrap around and secure to a standard backpack. The backpack attachment is configured to be used in a horizontal and a vertical orientation, the center zipper is configured to open a top portion of the center storage compartment in both the vertical and horizontal orientation of the backpack attachment, and one of the right side zipper and the left side zipper is configured to open a top portion of the corresponding storage compartment in both the vertical and horizontal orientation of the backpack attachment.

These and other aspects, objects, and features of the present disclosure will be understood and appreciated by those skilled in the art upon studying the following specification, claims, and appended drawings.

DETAILED DESCRIPTION

Figure 1:
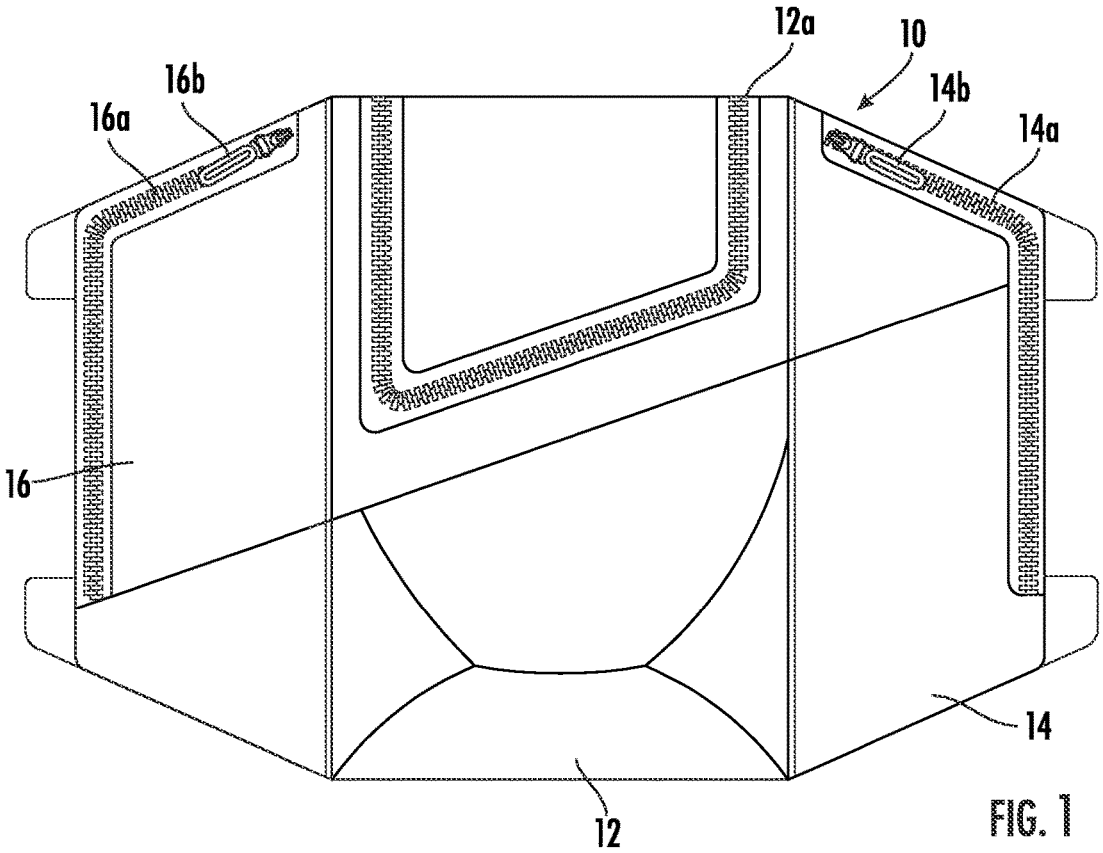
FIG. 1 is an elevated front view of an attachable gym bag according to an aspect of the present disclosure.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present disclosure is generally directed to an attachable sports bag that can be used in one orientation as a secondary bag for attachment to a primary backpack and in a second orientation as a stand-alone backpack. In either orientation the wearer/user has access to at least one compartment via a three-sided zipper that has a first side and an elongated opening access portion and a second side that can open. The attachable sports bag's primary function is to attach to the user's existing backpack or bag. The attachable bag is used by placing it in front of your backpack, wrapping the gym bag's two straps around and behind the backpack, clipping the buckles on the end of the two straps, and then tensioning the straps to fit the attachable gym bag firmly to the front of the backpack (the side facing away from the user's back when in use as a backpack). The tensioning of the straps keeps the attachable gym bag secured to a backpack such that they function as a unit and the attachable gym bag is sized to allow for access to the main backpack's compartments without having to disengage the attachable gym bag. There may also be a silicone print on the back side of the shoulder strap pads that, when pressed against the back of the backpack, allows the straps to stay in place better due to the gripping capabilities of the silicone print. The straps may wrap horizontally around the backpack, and are significantly longer than a typical gym bag and are typically long enough to be wrapped around any backpack. When the attachable gym bag is connected to a backpack, the main compartments of the backpack should still be accessible. If a secondary compartment of the backpack such as a smaller back or side pocket located further down on the backpack is not accessible, a user can still easily un-clip one of the buckles on the attachable gym bag, which are typically specifically designed to be magnetic buckles or other quick release buckling/attachment system and access the compartment. Thereafter, the attachable gym bag can then be easily re-clipped using the buckle or other quick release buckling/attachment system to secure the attachable gym bag. The quick release buckling/attachment system will typically be utilized on both straps of the attachable gym bag and be able to be engaged and disengaged by hand and without the use of tools, typically using one hand and without the use of tools.

The attachable gym bag can also be worn as a standalone gym bag over both shoulders as if it were its own backpack. To do this, the user detaches the gym bag from the backpack, clips the buckles back together, loosens the straps, rotates the gym bag 90 degrees, and then wears the gym bag like a small backpack. This dual versatility gives the user the option to still take the attachable gym bag with them to the gym on days when they are not using a backpack. Significantly, this avoids soiling the contents of a primary backpack that may have professional papers or student work that should not be damaged by shoes that may be used in outdoor sports or other athletic shoes and materials that may be dirty and sweaty. Through the use of the attachable gym bag according to an aspect of the present disclosure, a user can keep gym and sports apparel segregated from the contents of the primary backpack.

As shown in FIG. 1, the extended storage/attachable sports bag 10 for standard backpacks, which may also be extended storage for other items than sports apparel and equipment, is intended to wrap around, attach, and tighten to a user's existing standard hiking/school backpack using its own strapping system 20. FIG. 1 shows the front view of the attachable gym bag and the three separate storage compartments 12, 14, 16, and the strapping system 20 that allows the bag 10 to attach to any standard backpack. The main storage compartment 12 may be used for larger items in the extended storage bag 10. In one embodiment, the compartment 12 may be used as storage for shoes to be used at the gym or on an outdoor playing surface or field that may get dirty during use to keep those items segregated from even the other apparel or equipment within the bag's other compartments for shoes up to about a men's size 12 shoe. Compartment 12 may be about 11.5" in height, 3" in maximum depth, and may taper from 8" to 7" in width. There is an opening on the top side of the bag 10 in compartment 12 that may be secured by an easily opened and closed apparatus such as a zipper 12*a*. The material of the compartment 12 may be a durable polypropylene fabric along with details made of nylon fabric sewn onto the bottom 2" of the main storage compartment.

On either side of the main storage compartment 12 are lateral compartments 14, 16. In an embodiment, these two compartments 14, 16 are typically utilized as storage for gym clothes, towels, water bottles or other items to keep those items segregated from even the other apparel or equipment within the bag's other compartments. In another embodiment, each compartment 14, 16, is intended to fit one smaller shoe up to about a men's size 8. Each lateral compartment 14, 16 is independently enclosed by a zipper 14*a*, 16*a* that starts on the side opposite of the main storage compartment 12, runs up and across the top, and then down the opposite side parallel to the main storage compartment. The fabric used in the lateral compartments may be a durable polypropylene fabric. Details made of polyester mesh and nylon may cascade over the front of both shoe compartments 14, 16. The three compartment bags are sewn onto a backplate 30 to connect them all together. Like the details on the lateral compartments on the front, there may be polyester mesh and nylon details on the back side of the bag 10. The backplate may be lined with bias tape on the outside to ensure a clean edge.

Figure 2:
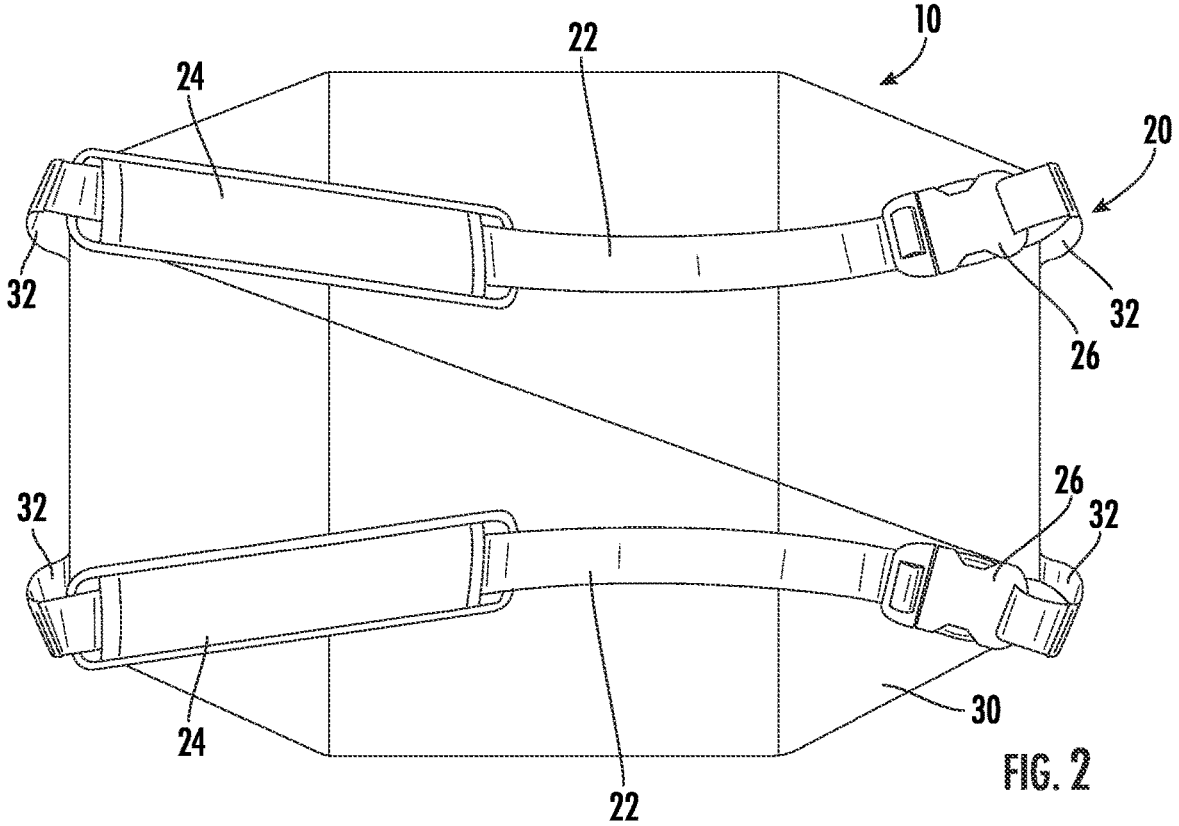
FIG. 2 is an elevated back view of an attachable gym bag according to an aspect of the present disclosure.

Shown in FIG. 2 is the strapping mechanism or system 20 used to attach the bag to nearly any regularly sized/standard backpack. Two lines of wide black straps 22, preferably from about 0.8 to about 2 inches wide and more preferably about 1 inch wide, are sewn to one side of the backplate 30. The length of the straps 22 may be adjusted by using buckles 26 with adjustability loops. The buckles 26 have a male end 26*a* and a female end 26*b*. The end 26*a* may have an adjustability loop that allows the user to easily loosen the strap when removing, and tighten the straps 22 when attaching. The buckle 26 may be a traditional buckle or may be a Woojin Magnetic Buckle from Woojin plastic corporation of Korea for easier and quicker attachment and detachment. The buckles may be a snap fit buckle or may be a magnetic buckling attachment system. Typically, the buckling systems of the present disclosure are those that may be engaged and disengaged by hand and without the use of tools and typically by one hand and without the use of tools.

Figure 9:
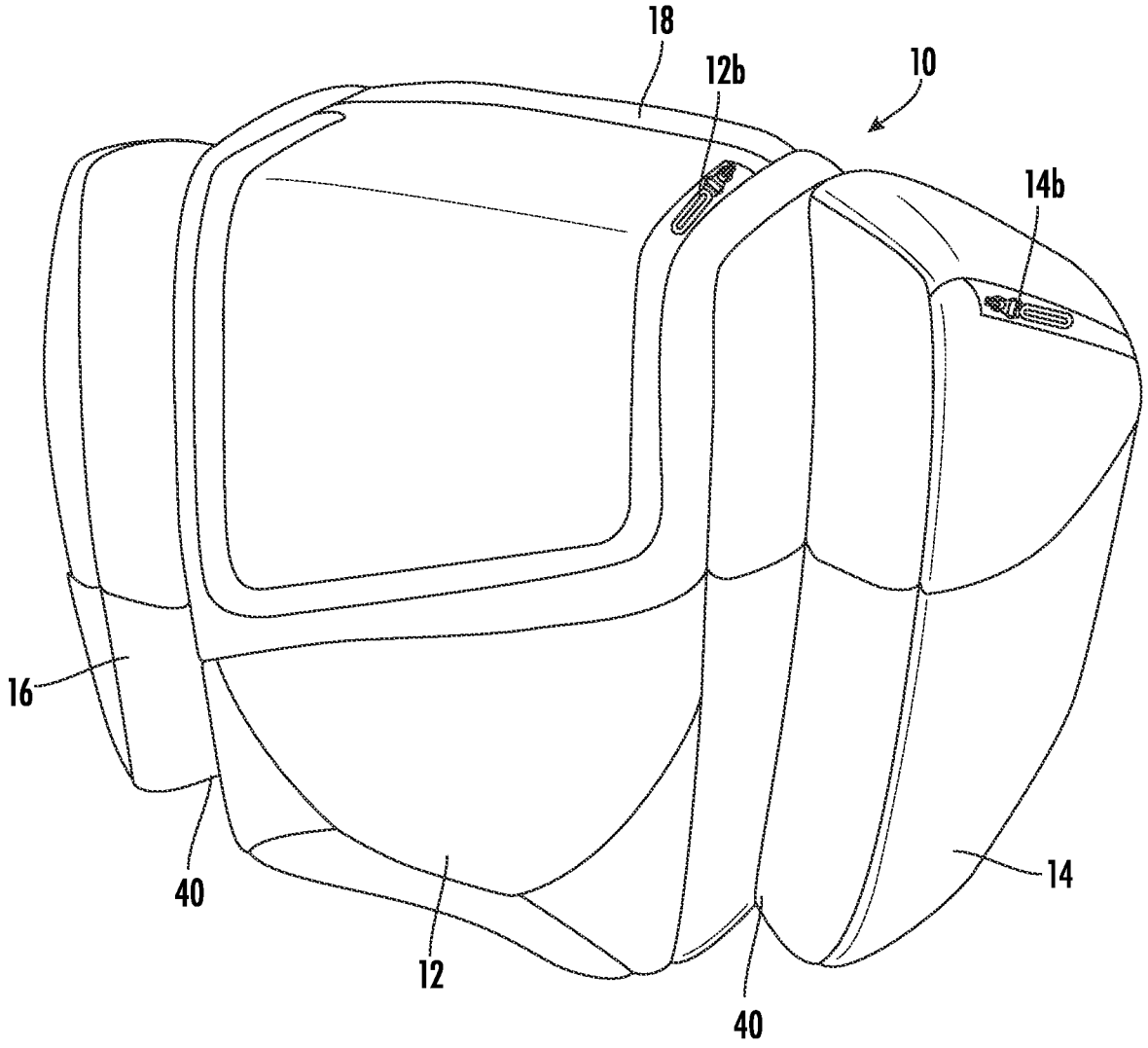
FIG. 9 is a front perspective view of an attachable gym bag according to an aspect of the present disclosure.
Figure 10:
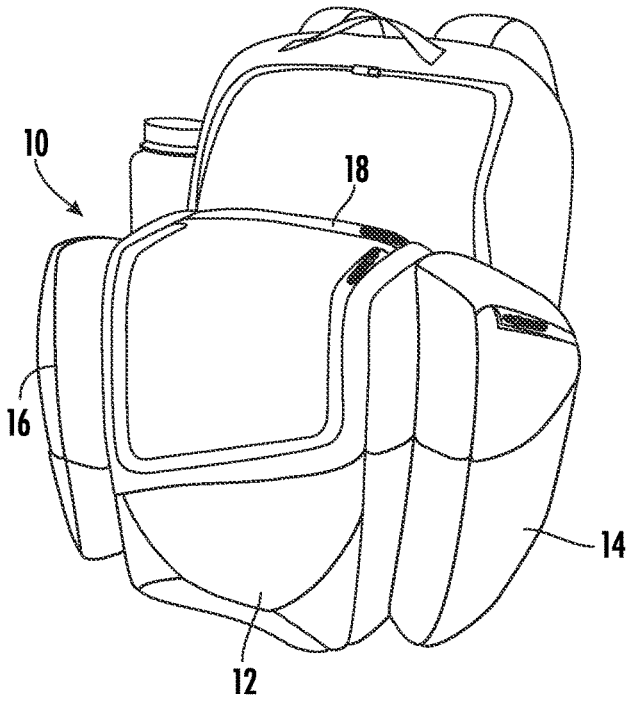
FIG. 10 is a front perspective view of an attachable gym bag according to an aspect of the present disclosure mounted as a secondary bag to a primary backpack typically used by students and some working professionals.

The straps 22 may further include padded portions 24. The padded portion 24 may include polyethylene (PE) foam padding and silicone printing. The foam padding allows for a tighter grip of the users backpack while the silicone printing prevents slippage of the straps 22 up and down the backpack. FIGS. 9 and 10 show the bag as it looks while in use and being worn by a user.

Regarding the bag's strapping system, the bag's straps 22 are typically connected securely to the primary body of the gym bag 10 via fabric tabs 32. These tabs 32 typically extend beyond the perimeter of the main body of the backpack backplate 30 and are heavily reinforced with stitching to ensure the straps will not rip out due to stress, heavy use, or repeated, rigorous use over time. The tabs typically extend about one inch beyond the backplate 30. The bottom, female magnetic or traditional clip 26*b* is in a fixed position at what has been designed to be the left side of the bag when in normal use, or the bottom of the gym bag when in the vertical, standalone position, although a person of ordinary skill would recognize that either end could have the end 26*b*. The orientation shown keeps the buckles 26 off the user's shoulders when they are using the gym bag as a standalone bag and allow for easier disengagement while in that configuration as well. The male end 26*a* of the magnetic clip is adjustable (non-fixed), so users can adjust the tension on the strap 22. This allows for users to increase how tightly, or loosely, the bag 10 holds to their backpack or their back while in use as a standalone backpack. The quick adjustment of the clips 26 also allows for users to loosen the straps in order to get items (i.e. a water bottle) out of their backpack. It also allows them to quickly retighten the straps 22 after getting such items out of the backpack.

The straps 22 are built at a length that allows them to be long enough to adjust/fit around nearly any backpack. The straps 22 are also short enough that they do not bother, get in the way, or agitate the user when the gym bag 10 is being used as a standalone. This means that if a user has a near empty, empty, or small backpack, the straps 22 are capable of tightening to a point that the attachable gym bag 10 is very secure to the bag. On the other hand, if a user has a large, full, or near full backpack, the straps 22 adjust or loosen to be longer. This allows the straps 22 to lengthen and accommodate larger bags, while still providing a tight fit. Typically, the straps are at least 150%, more typically at least 152%, of the length of the width of the backplate of the bag 10. This is typically 9 inches longer than the width of the backplate which is typically about 17 inches wide. The straps are typically about 26 inches in length from the end of the fabric tab 32 distal from the backplate to the end of the strap to the end of the strap and not including the male end (or female end) of the buckle that engages the buckle component engaged to the tab 32 on the opposite side of the bag 10.

The straps 22, also referred to as webbing, are preferably about 25 mm in width and made from a durable nylon/polyester fabric. The webbing is not limited to this material or size, however, and is subject to have other similar, or different materials in different variations of the bag. These types of materials may include expandable/stretchable materials, different colors, or other types of materials.

Unlike most gym bags, which typically only have drawstrings, the two straps 22 of the gym bag 10 may be covered by a soft, durable, padded shoulder pad 24. This is as opposed to no shoulder pad (i.e. drawstrings) or a plastic shoulder cover (often seen in duffle bags). Shoulder pads 24 on the attachable gym bag 10 may include a durable, synthetic, high denier fabric around the outside to increase its durability. This fabric on the outside, referred to as bias tape, is stitched down to the shoulder strap for durability and longevity. Brand logos may be featured on each strap in reflective print. Reflective print on the straps makes it easy to see the user at night. It also adds an elevated look and premium feel to the bag. The shoulder pads themselves are padded so that users do not have to have uncomfortable straps rubbing on their shoulders. The bag 10 typically includes movable shoulder straps. This allows them to be placed in the center of the backpack (back) while on the backpack, and moved to the shoulder position (of the user) when used as a standalone.

The back of the shoulder pads may have a silicone grip 24*a*. The grip may be patterned using a brand, model, or other logo. Silicone grips 24*a* allow the shoulder pads to secure the gym bag better to the backpack. The silicone grip 24*a* may also allow for the shoulder pads to grip the users shoulders better when the bag is being used as a standalone gym bag (separate from the backpack). Grip on the shoulder pad prevents it from sliding around when on the user's shoulder. It also helps keep the gym bag in more comfortable position. Overall, the padded, silicone printed shoulder pads 24 lead to a more elevated, comfortable, and less frustrating experience for the user.

The novel attachable gym bag strapping system allows the bag 10 to be attached in multiple orientations. The primary position is the horizontal position. In this position, the bag 10 is oriented in a horizontal position, and the strap system 20 wraps around a backpack for a secure fit. This position was designed to be used with backpacks. It allows the user to easily access to the gym bag's 10 compartments when packing and unpacking as well as at least the main compartment of a standard backpack that opens at the top of a backpack. Also, it allows for easy access to the compartments when the primary backpack is "slung" over a single shoulder of the user while walking or standing. Because the pockets 12, 14, 16, are accessible from the top (in the horizontal position), the user can easily reach all pockets without taking their backpack off. The small, stowaway compartment 18 is especially easy to access in case the user needs an extra space to store their keys, wallet, phone, earphones, etc.

The bag 10 functions best when attached to the bottom (lower) half of a backpack. As discussed above, this allows the user to still have access to most compartments included in a modern backpack, including a laptop zippered pocket, main center compartment, small supplies pocket in the front of the bag, and full access to both side water bottle holders. While in this position, the user typically will have full access to all pockets of the primary backpack without needing to take off the sports bag 10. In the rare event a specific primary backpack model has a pocket that is blocked, the user can undo the top magnetic clip or buckle 26 (thus allowing the bag to fall forward slightly), and gain access to any covered pocket. As discussed above this can typically be done by hand and without the use of tools and more typically using one hand and without the use of tools. This provides a contingency to the small backpacks that have one or more pockets covered by the bag 10 when the bag 10 is engaged to the primary backpack. When using this mechanism, the clips 26 allow the user to easily snap the buckle clips into place and continue with their day.

While the bag 10 was designed primarily to be in the horizontal position, it has the capabilities and intention to be used in a variety of other ways. While on the backpack, the user can attach the bag near the base (provides most access to pockets), towards the top of the backpack (provides more back support, but covers more pockets), or in a vertical position (rotated 90 degrees with the strap system 20 running over the top and bottom of the backpack).

Figure 11:
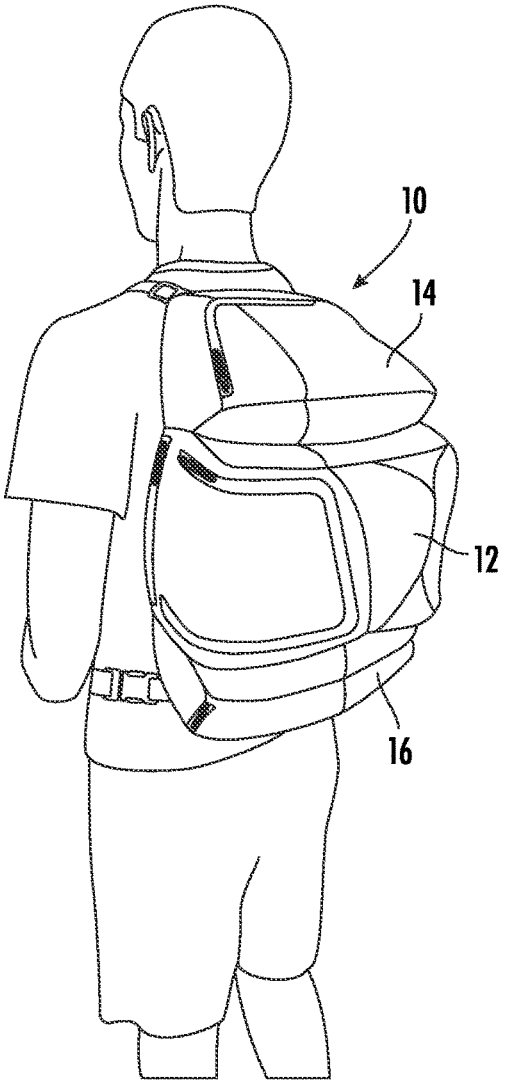
FIG. 11 is a perspective view of the attachable gym bag according to an aspect of the present disclosure used directly as a backpack in a second orientation that is about 90 degrees from the orientation shown in FIG. 10.
Figure 12:
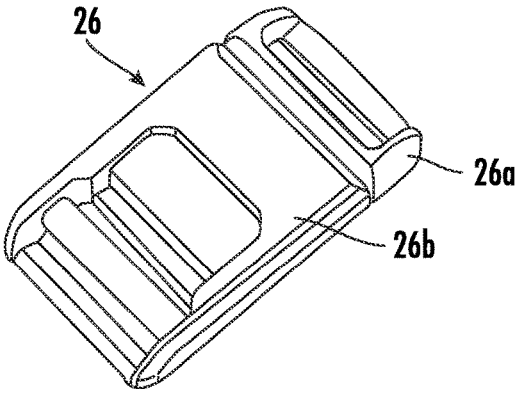
FIG. 12 is a perspective view of a magnetic clasp utilized as a component of the attachable gym bag according to an aspect of the present disclosure.
Figure 13:
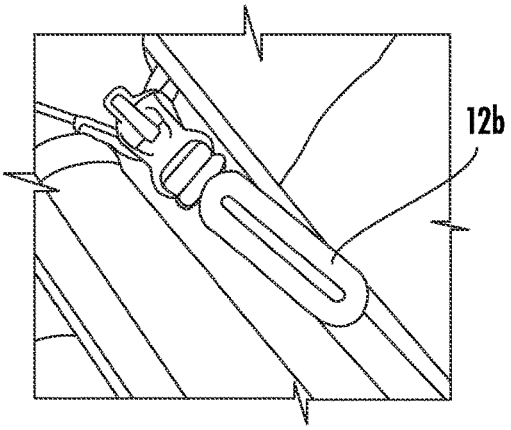
FIG. 13 is an enlarged view of the zipper pull specifically for the attachable gym bag according to an aspect of the present disclosure with an elongated portion with center slot.

The attachable gym bag can also be used as a standalone bag. This means that it does not need to be attached to a backpack. The bag was designed to function as both an attachable gym bag, and as a standalone gym bag. The pockets of the attachable gym bag 10 are all designed in such a way/orientation that they are each fully, and easily accessible in all possible orientations of the bag (with primary consideration given to the vertical standalone position, and horizontal position used with backpacks). As a standalone gym bag, the bag 10 is oriented in a vertical position as shown in FIG. 11. Having the buckle clips 26 at the bottom makes it easy for the user to adjust the fit of the gym bag 10. It is also designed intentionally this way so the plastic buckles 26 are kept off the user's shoulders and neck. Cushioned shoulder pads 24 are not fixedly attached to the straps 22, and are able to slide up to the user's shoulder for a comfortable experience when using the gym bag 10 by itself (this is as opposed to raw drawstrings found in drawstring bags, which dig into the shoulder, or the plastic shoulder adjuster found in duffels, which have no padding). Silicone printed grips 24*a* on the underside of the shoulder pads 24 allow the shoulder pads 24 to stay in place on the user, thus preventing frustration with slippage, and allowing for a more stable fit. The female buckle clips 26*b* on one side of the bag were designed primarily to connect to the male buckle clips 26*a* directly opposite of them on the other side of the bag 10. The bag also provides the user the flexibility to create alternative strapping arrangements, such as crossing the straps 22 in an "X" orientation, connecting just one strap 22, or crossing a single strap 22 (female 26*b* to diagonal male 26*a* on the opposite side of the bag). This allows the user to orient the attachable gym bag 10 in a position that best suits their preferences. Some of these alternative orientations would allow them to create new strapping arrangements such as the "X" aforementioned, or to use the bag more as a shoulder bag (only one strap connected). Typically, the male ends of both straps will be able to engage either of the female end of the corresponding or opposing straps. They are typically interchangeable with one another.

The attachable gym bag 10 contains four separate zippered compartments 12, 14, 16, 18. Three of the compartments 12, 14, 16 are located on the front of the gym bag, the sides facing away from the primary backpack or the wear's back when used alone. The fourth compartment 18, is located on the top of the bag 10 (while attached to a backpack, or side of the bag if the gym bag is being used standalone). The three compartments on the front of the attachable gym bag consist of a center compartment 12 and two side compartments 14, 16. The side compartments 14, 16 on either side of the center compartment may be approximately equal in volume to distribute weight evenly. The center compartment 12 on the front of the bag 10 is a rectangular prism with a volume preferably of approximately 480 cubic inches or about 7.87 liters. The opening of the center compartment has a first side of longer length than the opposing side and an angled center zipper portion interconnecting them. The side compartments 14, 16 on the front of the bag are trapezoidal prisms or, more specifically, rectangular truncated pyramids, and are preferably about 162 cubic inches or 2.65 liters in volume. The stowaway pocket 18 is constructed into a triangular prism that is preferably about 15.99 cubic inches or 0.26 liters in volume. All the compartments are constructed out of fabric material so these are all the base measurements and volumes of the compartments, but due to the nature of fabric, the overall volume could be increased due to the stretch of fabric.

Each compartment has different intended uses, but the uses may be varied by the user. The center compartment 12 on the front of the attachable gym bag 10 is typically intended to hold the user's shoes. The opening of the center compartment 12 is intentionally larger than the other pockets and angled so it is simpler to place the user's shoes inside. The zippered opening 12*a* to the center compartment preferably runs roughly from about 21 to about 25 inches in length, more typically about 23.5 inches (59.69 cm) in length. The zippered compartment 12 may open on the top of the gym bag, curve to the front side of the gym bag, and then curves back to the top side of the gym bag where it ends. This compartment 12 was designed to fit up to a men's size shoe 12 comfortably, but depending on the brand of shoe, larger sizes can fit, as well. If the user chooses not put shoes in the center compartment 12, it can be used to house their clothing or other items. This is an especially convenient feature for smaller framed individuals such as women, shorter men, or other individuals. This is because individuals with smaller feet can place their shoes in the side compartments 14, 16 (comfortably, size 8 and smaller). This allows individuals with smaller feet to benefit from the same quick, clean access to their shoes. It comes with the added benefit that they don't get stuck with extra space in the center compartment for shoes that don't require that much space. This provides them with more space for clothing, shower gear, or other items.

The typical primary function of the side compartments 14, 16 is to house the user's gym going clothing—clean or dirty. The size of the side compartments 14, 16 allows storage of the gym goers' necessities. While these "necessities" may be compromised of a variety of items, special consideration was given to make sure they can fit a shirt, shorts (or pants), socks, compression shorts (or undergarments), and a small rolled up towel. The side compartments may be able to hold one men's shoe size 8 or lower in each side. This way, users with smaller feet can place one shoe in each side compartment and use the center compartment to store their gym clothes (as mentioned previously). Of course, a person of ordinary skill in the art could make larger side compartments 14, 16 without deviating from the present disclosure.

Angled zippers 14*a*, 16*a* make it possible for the compartments to be used seamlessly between vertical and horizontal orientations and allow easier access as discussed herein. The zippered openings on both side compartments 14, 16 are preferably about 11 inches (27.94 cm) in length. The zippered openings on the side compartments 14, 16 open at the top of the gym bag 10, run along the top edge, and then down the side of the gym bag, typically proximate the side of the seam of the compartment. The side compartment's zippered openings feature an angle, preferably about a 114-degree angle that occurs near the 4.25-inch mark from the initial opening of the zipper. Zipper pullers 14*b*, 16*b* are located at the top (when in horizontal position) of the compartment so when the gym bag is in the horizontal position, users do not have to pull the zipper all the way down to access, or insert their gear. This also prevents contents from spilling out when accessing the compartments 14, 16. In the vertical position, this allows the pocket to function similarly to a traditional purse or backpack zipper. The difference in the vertical position, compared to traditional (upside down "U" shape) shaped zippers, is that the right side (in vertical position) is cut off/shorter. This is because that side (right side, vertical position) is not necessary for full access to the compartment's contents. Eliminating the extra zipper length also prevents the user from mistakenly opening the wrong end, thus risking their contents falling out.

Figure 3:
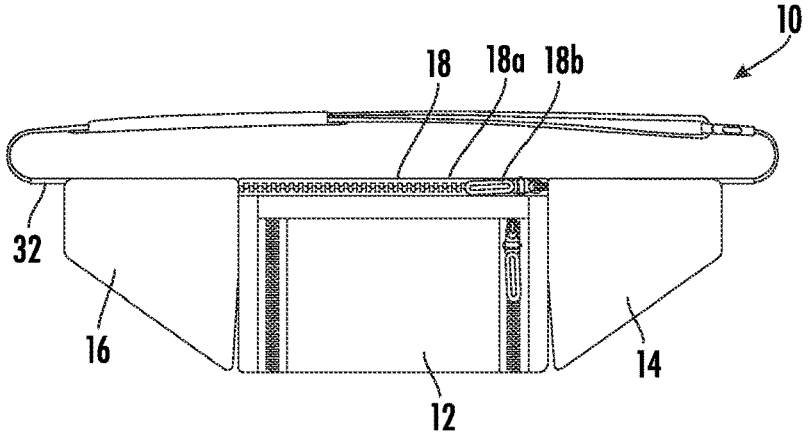
FIG. 3 is a top view of an attachable gym bag according to an aspect of the present disclosure.
Figure 4:
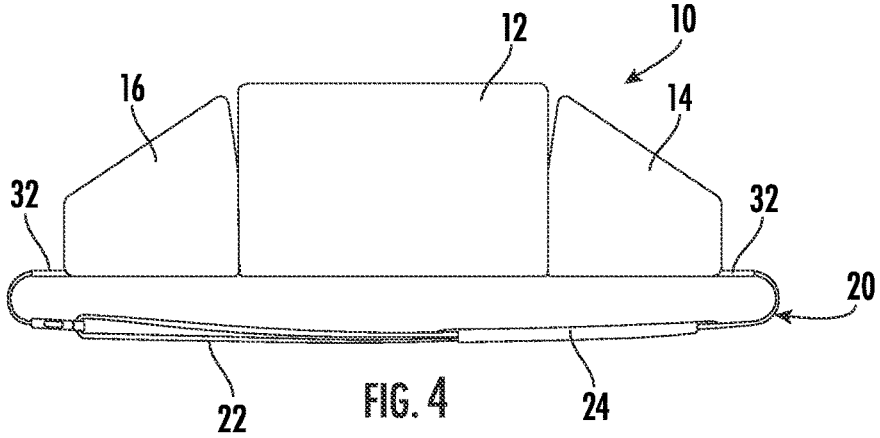
FIG. 4 is a bottom view of an attachable gym bag according to an aspect of the present disclosure.
Figure 5:
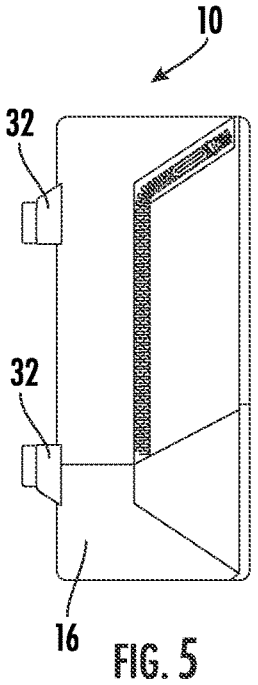
FIG. 5 is an elevated left side view of an attachable gym bag according to an aspect of the present disclosure.
Figure 6:
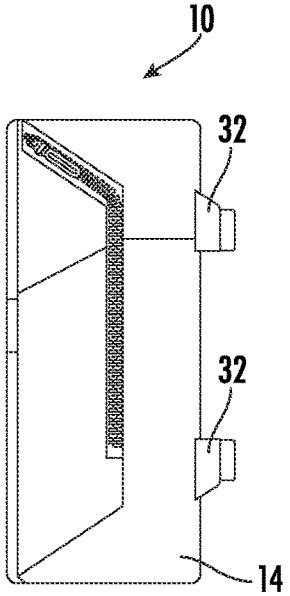
FIG. 6 is an elevated right side view of an attachable gym bag according to an aspect of the present disclosure.
Figure 7:
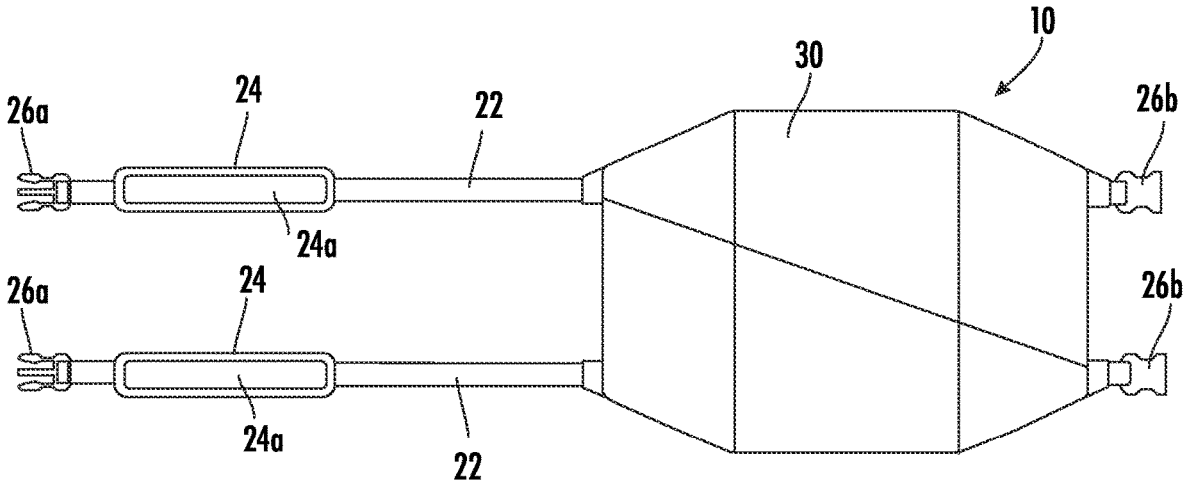
FIG. 7 is an elevated back view of an attachable gym bag according to an aspect of the present disclosure with the straps in the disengaged and extended position.
Figure 8:
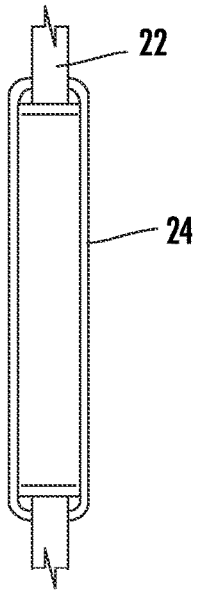
FIG. 8 is an enlarged view of the cushioned strap sections of the straps of the attachable gym bag according to an aspect of the present disclosure.

The bag 10 also contains a stowaway pocket 18 that is typically intended to fit a user's smaller personal items like a phone, wallet, keys, etc. The pocket is designed to accommodate all sizes of smart phones, as well. The opening for the stowaway pocket 18 is preferably about an eight-inch laterally extending zipper that runs straight with no angles across the top of the bag 10 as shown in FIG. 3 and behind at least a portion of the main compartment 12. The stowaway pocket 18 is preferably about eight inches deep and is sandwiched in between the liner material for the center compartment 12 and the outer material of the gym bag so as to not interfere with the user filling the center compartment 12.

The side compartments 14, 16 may be attached to the center compartment 12 in a unique way. The attachment points between the side 14, 16 and center compartment 12 on the front side of the gym bag 10 is cut in at least about 1 inch, but more typically about two inches. The cut-in 40 (see FIG. 9) gives the sports bag 10 a compartmental look and helps to separate the interior of the compartments. The cut-in 40 allows the attachable gym bag 10 to wrap around a backpack better by providing some flexibility. When secured tightly to a backpack, the attachable gym bag's cut-in allows the side compartments to bend away from the center compartment, relieving the pressure on the sewn seams that connect the side compartments to the center compartment.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovation have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovation. Other substitutions, modifications, changes, and omissions may be made in the design, operating conditions, and arrangement of the desired and other exemplary embodiments without departing from the spirit of the present innovation.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A backpack system comprising a first flexible backpack having a main storage compartment, a first side storage compartment having a first side storage compartment interior volume, and a second side storage compartment having a second side storage compartment volume;

wherein the main storage compartment has a main compartment interior volume that is greater than the first side storage compartment volume and the second side storage compartment volume;

wherein the flexible backpack system further comprises a backplate having a first side and a second side with at least a first strap and a second strap, the first strap having opposing first strap ends engaged to each of the first side and the second side and the second strap having opposing second strap ends engaged to each of the first and second side wherein the first strap engaging ends and the second strap ends each engage one another via a buckling system that is operable by hand and without the use of tools and is chosen from the group consisting of a snap friction fitting connection buckle and a magnetic buckling system;

wherein the backplate has a rectangular center section having a shorter side on each of a top and bottom of the flexible backpack system and a left side trapezoidal portion and a right side trapezoidal portion adjacent a left side and a right side of the backplate such that a bottom of the left trapezoidal portion coincides with a left long side of the rectangular center section and a bottom of the right trapezoidal portion coincides with a right long side of the rectangular center section;

wherein each of the compartments has an opening and closing mechanism chosen from the group consisting of a hook and loop fastening system and a zipper system; and wherein a top opening of the main compartment is accessed via the opening and closing mechanism of the main storage compartment to allow the user access to the interior volume of the main storage compartment when in a horizontal orientation and a top opening of the first side storage compartment is accessed via the opening and closing mechanism of the first side storage compartment, which is positioned at a top of the first side storage compartment when the flexible backpack system is positioned in a vertical position and is positioned at a side of the first side storage compartment when the flexible backpack system is positioned in a horizontal position.

2. The flexible backpack system of claim 1, wherein the straps are each a planar fabric material engaged with the buckling system of each strap.

3. The flexible backpack system of claim 2, wherein the opening and closing mechanism of each compartment is a zipper system.

4. The flexible backpack system of claim 1, wherein the opening and closing mechanism of each compartment is a zipper system and the zipper system for opening and closing and obtaining access to the interior volumes of each compartment is asymmetrical.

5. The flexible backpack system of claim 4, wherein the zipper comprises a zipper pull having an elongated hollowed center section with oblong ends and with reflective components affixed thereto.

6. The flexible backpack system of claim 1, wherein the left trapezoidal portion has a top side with an upper corner portion and a lower corner portion and wherein the right trapezoidal portion has a top side with an upper corner portion and a lower corner portion and wherein a reinforced fabric tab is sewn into engagement with each of the upper corner portion and the lower corner portion of the left trapezoidal portion and the upper corner portion and the lower corner portion of the right trapezoidal portion such that the fabric tabs have either a looped portion that engages either the male or female portion of the buckling system and the opposing side fabric tab has a strap sewn into engagement with an end of an elongated fabric strap having the opposing male or female portion and the opposite end thereof.

7. The flexible backpack system of claim 6, wherein each of the two elongated fabric straps has a movable pad that moves along the elongated fabric strap.

8. The flexible backpack system of claim 7, wherein the moveable pad further comprises silicon printing having an increased resistance to movement when in contact with another fabric surface.

9. The flexible backpack system of claim 8, wherein each of the two elongated fabric straps have a length of at least about 150% of a width of the backplate from a top side of the left trapezoidal portion and a top side of the right trapezoidal portion.

10. The flexible backpack system of claim 1, wherein the opening and closing engagement mechanism is a zipper and wherein the zipper extends within the center section for a distance along a first side portion of the center section and then diagonally for a distance of a center portion of the zipper mechanism and then along an opposite side portion of the center section that is opposite the first side portion for a second distance and the distance along the first side portion is different than the second distance and wherein the zipper portion along the first side portion and the zipper portion along the opposite side portion are parallel with one another.

11. The flexible backpack system of claim 1, wherein female ends of the buckling system are attached to the first side of the backplate and male ends of the buckling system are attached to the second side of the backplate.

12. The flexible backpack system of claim 9, further comprising a secondary compartment spaced behind the main compartment and between the main compartment and the backplate.

13. The flexible backpack system of claim 12, further comprising a second backpack that is larger than the first flexible backpack and wherein the first flexible backpack engages the second backpack when in the horizontal position and the second backpack is carried by a user.

14. The flexible backpack system of claim 1, wherein the first side storage compartment and the second side storage compartment are each engaged with opposing sides of the main storage compartment along only a portion of the opposing sides such that a notch is formed and the first side compartment and second side compartment are allowed to flex when the straps are tightened and the backplate curves without pulling on exterior vertical side portions of the main storage compartment.

15. A flexible backpack having a center storage compartment, a left side storage compartment having a left side storage compartment interior volume, and a right side storage compartment having a right side storage compartment volume;

wherein the center storage compartment has a center compartment interior volume that is greater than the left side storage compartment volume and the right side storage compartment volume;

wherein the flexible backpack system further comprises a backplate having a first side and a second side with at least a first strap and a second strap, the first strap having first strap ends opposite one another and engaged to the first side and the second side and the second strap having second strap ends opposite one another and engaged to the first and second side wherein the first strap ends and the second strap ends each engage one another via a buckling system that is operable by hand and without the use of tools and is chosen from the group consisting of a snap friction fitting connection buckle and a magnetic buckling system;

wherein the backplate has a rectangular center section having a shorter side on each of a top and bottom of the flexible backpack system and a left side trapezoidal portion and a right side trapezoidal portion adjacent a left side and a right side of the backplate such that a bottom of the left trapezoidal portion coincides with a left long side of the rectangular center section and a bottom of the right trapezoidal portion coincides with a right long side of the rectangular center section;

wherein each of the compartments has a separate opening and closing mechanism to allow selective access to the interior volume of each compartment; wherein a top opening of the center storage compartment is accessed via the opening and closing mechanism of the center storage compartment to allow the user access to the interior volume of the center storage compartment when in a horizontal orientation and a top opening of the left side storage compartment is accessed via the opening and closing mechanism of the left side storage compartment, which is positioned at a top of the left side storage compartment when the flexible backpack system is positioned in a vertical position and is positioned at a side of the left storage compartment when the flexible backpack system is positioned in a horizontal position; and wherein the two elongated planar fabric straps have a length of at least about 150% of the width of the backplate from a top side of the left trapezoidal portion and a top side of the right trapezoidal portion.

16. The flexible backpack of claim 15, wherein each opening and closing mechanism for obtaining access to the interior volumes of each compartment is asymmetrical from one side to the other.

17. The flexible backpack system of claim 16, wherein the left trapezoidal portion has a top side with an upper corner portion and a lower corner portion and wherein the right trapezoidal portion has a top side with an upper corner portion and a lower corner portion and wherein a reinforced fabric tab is sewn into engagement with each of the upper corner portion and the lower corner portion of the left trapezoidal portion and the upper corner portion and the lower corner portion of the right trapezoidal portion such that the fabric tabs have either a looped portion that engages either the male or female portion of the buckling system and the opposing side fabric tab has a strap sewn into engagement with an end of an elongated fabric strap having the opposing male or female portion and the opposite end thereof; and wherein each of the two elongated fabric straps have a movable pad that moves along the elongated fabric strap.

18. The flexible backpack system of claim 17, further comprising a secondary compartment spaced behind the main compartment and between the main compartment and a backplate.

19. A backpack attachment for use with a standard backpack or as a standalone backpack, the backpack attachment comprising:

a backplate, wherein the backplate has a rectangular center section having a shorter side on each of a top and bottom of the flexible backpack system and a left side trapezoidal portion and a right side trapezoidal portion adjacent a left side and a right side of the backplate such that a bottom of the left trapezoidal portion coincides with a left long side of the rectangular center section and a bottom of the right trapezoidal portion coincides with a right long side of the rectangular center section, wherein backplate has at least a first strap and a second strap, the first strap having opposing first strap ends engaged to each of the left and right side trapezoidal portions and the second strap having opposing second strap ends engaged to each of the left and right side trapezoidal portions, and wherein the first strap engaging ends and the second strap ends each engage one another via a buckling system;

a center storage compartment coupled with the backplate and having a center zipper;

a right side storage compartment coupled with the backplate and located on the right side of the center storage compartment and having a right zipper;

a left side storage compartment coupled with the backplate and located on the left side of the center storage compartment and having a left zipper; and wherein the first and second straps are configured to wrap around and secure to a standard backpack;

wherein the backpack attachment is configured to be used in a horizontal and a vertical orientation;

wherein the center zipper is configured to open a top portion of the center storage compartment in both the vertical and horizontal orientation of the backpack attachment; and wherein one of the right side zipper and the left side zipper is configured to open a top portion of the corresponding storage compartment in both the vertical and horizontal orientation of the backpack attachment.

* * * * *